US009330810B2

(12) United States Patent
Han et al.

(10) Patent No.: US 9,330,810 B2
(45) Date of Patent: May 3, 2016

(54) SYNTHETIC ESTER-BASED DIELECTRIC FLUID COMPOSITIONS FOR ENHANCED THERMAL MANAGEMENT

(71) Applicant: Dow Global Technologies LLC, Midland, MI (US)

(72) Inventors: Suh Joon Han, Belle Mead, NJ (US); Dirk B. Zinkweg, Katy, TX (US); Zenon Lysenko, Midland, MI (US)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 14/348,360

(22) PCT Filed: Sep. 26, 2012

(86) PCT No.: PCT/US2012/057291
§ 371 (c)(1),
(2) Date: Mar. 28, 2014

(87) PCT Pub. No.: WO2013/049170
PCT Pub. Date: Apr. 4, 2013

(65) Prior Publication Data

US 2014/0252281 A1 Sep. 11, 2014

Related U.S. Application Data

(60) Provisional application No. 61/541,572, filed on Sep. 30, 2011.

(51) Int. Cl.
*H01B 3/24* (2006.01)
*H01B 3/20* (2006.01)

(52) U.S. Cl.
CPC ... *H01B 3/24* (2013.01); *H01B 3/20* (2013.01)

(58) Field of Classification Search
USPC ..... 252/579, 213; 554/213, 167
See application file for complete search history.

(56) References Cited

U.S. PATENT DOCUMENTS

| | | | | |
|---|---|---|---|---|
| 5,958,851 | A * | 9/1999 | Cannon et al. | 508/491 |
| 6,340,658 | B1 * | 1/2002 | Cannon et al. | 508/491 |
| 6,340,659 | B1 * | 1/2002 | Kocsis et al. | 508/518 |
| 6,726,857 | B2 * | 4/2004 | Goedde et al. | 252/570 |
| 7,476,344 | B2 | 1/2009 | Sunkara et al. | |
| 2008/0283803 | A1 * | 11/2008 | Rapp et al. | 252/578 |
| 2009/0140830 | A1 * | 6/2009 | Amanullah et al. | 336/94 |
| 2014/0252281 | A1 * | 9/2014 | Han et al. | 252/579 |

FOREIGN PATENT DOCUMENTS

| | | | |
|---|---|---|---|
| SG | 177875 | A1 * | 2/2012 |
| WO | 2013049170 | A | 4/2013 |

OTHER PUBLICATIONS

PCT/ US2012/057291, International Search Report, mailed Jan. 31, 2013.
PCT/US2012/057291, International Preliminary Report on Patentability, mailed Jan. 4, 2014.

* cited by examiner

*Primary Examiner* — Nicole M Buie-Hatcher
*Assistant Examiner* — M. Reza Asdjodi

(57) ABSTRACT

A dielectric fluid composition for electrical apparatus comprises a functionalized methyl-12-carboxy methyl stearate having desirable properties including a pour point less than −30° C. and a fire point greater than 250° C. It may be prepared by a process wherein methyl-12-hydroxy methyl stearate is transesterified by reaction with a C3-C20 alcohol to form the hydroxy methyl ester, followed by reaction with a linear or branched C4-C20 carboxylic acid selected from free acid chlorides, fatty acids, carboxylic acid anhydrides, and combinations thereof. The second step serves to end-cap the hydroxyl groups, thereby producing the functionalized methyl-12-carboxy methyl stearate compound that exhibits improved thermoxidative stability and low temperature flowability, as well as increased fire point.

Figure 1:
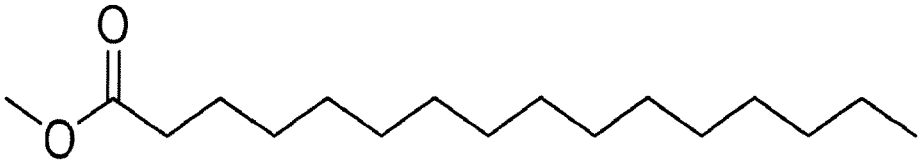
Figure 1:
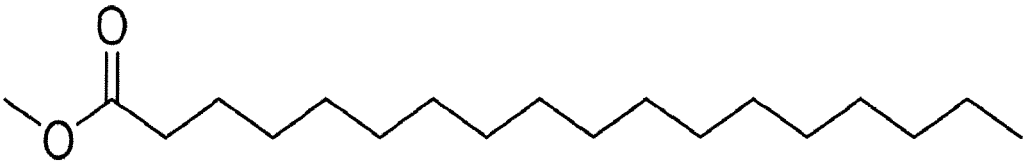
Figure 1:
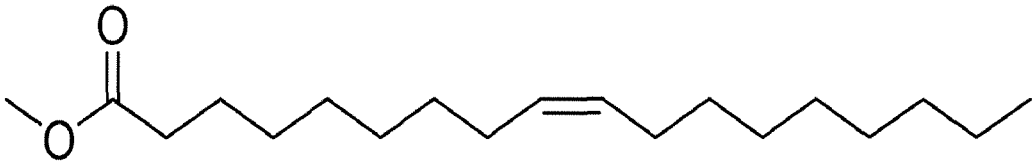
Figure 1:
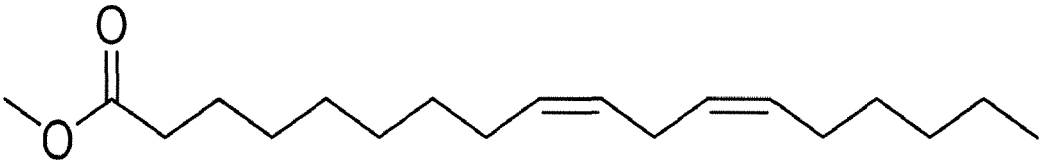
Figure 1:
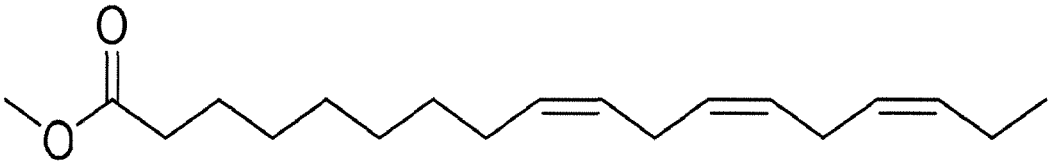

5 Claims, 3 Drawing Sheets methyl palmitate methyl stearate

Methyl oleate

Methyl linoleate

Methyl linolenate

SYNTHETIC ESTER-BASED DIELECTRIC FLUID COMPOSITIONS FOR ENHANCED THERMAL MANAGEMENT

CROSS-REFERENCE TO RELATED APPLICATIONS

This application is a non-provisional application claiming priority from the U.S. Provisional Patent Application No. 61/541,272, filed on Sep. 30, 2011, entitled "SYNTHETIC ESTER-BASED DIELECTRIC FLUID COMPOSITIONS FOR ENHANCED THERMAL MANAGEMENT," the teachings of which are incorporated by reference herein, as if reproduced in full hereinbelow.

BACKGROUND

1. Field of the Invention

The invention relates particularly to the field of dielectric fluids used for thermal management of transformers. More particularly, it relates to improved compositions that provide both electrical insulation and/or heat dissipation for transformers and other apparatus.

2. Background of the Invention

Thermal management of transformers is known to be critical for the safety of transformer operation. Although conventional transformers operate efficiently at relatively high temperatures, excessive heat is detrimental to transformer life. This is because transformers contain electrical insulation which is utilized to prevent energized components or conductors from contacting, or arcing over, the other components, conductors, or internal circuitry. In general, the higher the temperatures experienced by the insulation, the shorter its life. When insulation fails, an internal fault or short circuit, sometimes leading to fire, may occur.

In order to prevent excessive temperature rise and premature transformer failure, transformers are generally filled with a liquid coolant to dissipate the relatively large quantities of heat generated during normal transformer operation. The coolant also functions to electrically insulate the transformer components as a dielectric medium. The dielectric liquid must be able to cool and insulate for the service life of the transfer, which is in a number of applications in excess of twenty years. Because dielectric fluids cool the transformer by convection, the viscosity of a dielectric fluid at various temperatures is one of the key factors in determining its efficiency.

Mineral oils have been tried in various dielectric formulations, particularly because they may offer a degree of thermal and oxidative stability. Unfortunately, however, mineral oils are believed to be environmentally unfriendly and may exhibit unacceptably low fire points, in some cases as low as 150 degrees Celsius (° C.) which is undesirably close to the maximum temperatures to which a dielectric fluid is likely to be exposed during use in a given application, such as a transformer. Because of their low fire points, researchers have sought alternative dielectric materials.

In this search for alternatives, vegetable oils were early-identified as a dielectric medium that could be environmentally friendly and exhibit the desired characteristics of desirably high fire points (significantly greater than 150° C.) and desirable dielectric properties. They may also be biodegradable within a short time. Finally, they may offer enhanced compatibility with solid insulating materials.

Researchers looking for alternative have identified a number of possible fluids. For example, U.S. Pat. No. 6,340,658 B1 (Cannon et al.) describes a vegetable oil-based electrically-insulating fluid, which is environmentally friendly and has a high flash point and high fire point. The base oil is hydrogenated to produce maximum possible oxidative and thermal stability of the oil. Vegetable oils are selected from soy bean, sunflower, canola and corn oils as some examples.

US Patent Publication 2008/0283803 A1 describes a dielectric composition comprising at least one refined, bleached, winterized, deodorized vegetable oil and at least one antioxidant. The dielectric fluid further comprises at least one synthetic ester, wherein the synthetic ester is a bio-based material. The patent defines the term "synthetic ester" as referring to esters produced by a reaction between (1) a bio-based or petroleum derived polyol: and (2) a linear or branched organic acid that may be bio-based or petroleum derived. The term "polyol" refers to alcohols with two or more hydroxyl groups. Suitable examples of the bio-based synthetic esters included are those produced by reacting a polyol with an organic acid with carbon chain lengths of C8-C10 derived from a vegetable oil such as, for example, coconut oil. The synthetic esters also include synthetic pentaerythritol esters with C7-C9 groups. Other polyols suitable for reacting with organic acid to make the synthetic esters include neopentyl glycol, dipentaerythritol, and e-ethylhexyl, n-octyl, isooctyl, isononyl, isodecyl and tridecyl alcohols.

Despite these and other efforts by a variety of researchers, there is still a need to develop dielectric fluids that have the desired combination of properties as well as economic viability and capability for biodegradation.

SUMMARY OF THE INVENTION

In one aspect the invention is a dielectric fluid composition for electrical apparatus comprising a functionalized methyl-12-carboxy methyl stearate having at least one property selected from a number average molecular weight ($M_n$) from 400 Daltons (Da) to 10,000 Da, a dielectric breakdown strength greater than 20 kilovolts/1 mm gap (kV/mm), a dissipation factor less than 0.2 percent (%) at 25° C., a fire point greater than 250° C., a kinematic viscosity less than 35 centistokes (cSt) at 40° C., a pour point less than −30° C., and an acidity less than 0.03 milligrams potassium hydroxide per gram sample (mg KOH/g), and a combination thereof.

In another aspect the invention is a process for preparing a dielectric fluid composition comprising (a) reacting methyl-12-hydroxy methyl stearate and a linear or branched C3 to C20 alcohol under conditions suitable to form a hydroxy methyl ester and (b) reacting the hydroxy methyl ester and a carboxylic acid selected from the group consisting of linear and branched C4-C20 free acid chlorides, fatty acids, carboxylic acid anhydrides, and combinations thereof; under conditions suitable to form a functionalized methyl-12-carboxy methyl stearate.

DETAILED DESCRIPTION OF THE EMBODIMENTS

The invention provides a dielectric fluid composition that is useful for thermal management in electrical apparatuses, and has a variety of desirable properties. These properties may include, in specific and non-limiting embodiments, a dielectric breakdown strength greater than 20 kilovolts/ mm gap, a dissipation factor less than 0.2 percent (%) at 25° C., a fire point greater than 250° C., a kinematic viscosity less than 35 centistokes (cSt) at 40° C., a pour point less than −30° C., and an acidity less than 0.03 milligrams potassium hydroxide per gram of sample (mg KOH/g). In addition it has a number average molecular weight ($M_n$) ranging from 400 Daltons (Da) to 10,000 Da, which helps to ensure a viscosity that is useful in the target applications. The American Society for Testing and Materials (ASTM) standards used to determine these properties are indicated in Table 1 hereinbelow.

TABLE 1

ASTM standards and properties tested.

| Property and units | ASTM standard |
|---|---|
| Dielectric breakdown strength, kV/mm gap | ASTM D1816 |
| Dissipation factor, % at 25° C. | ASTM D924 |
| Fire point, ° C. | ASTM D92 |
| Kinematic viscosity, cSt at 40° C. | ASTM D445 |
| Pour point, ° C. | ASTM D97 |
| Acidity, mg KOH/g | ASTM D974 |

The dielectric fluid compositions may be prepared starting with either a commercially available product, methyl-12-hydroxy methyl stearate (abbreviated hereinafter as "HMS"), or, in a pre-process step, from a commonly known and widely available vegetable oil, soybean oil. Soybean oil comprises significant amounts of unsaturated acids including, in particular, oleic, linoleic, and linolenic acids, all of which contain 18 carbon atoms. It also contains relatively smaller amounts of saturated fatty acids including stearic acid, which is another 18-carbon chain compound, and the 16-carbon chain compound palmitic acid. The unsaturated acids are shown in FIG. 1.

Figure 2:
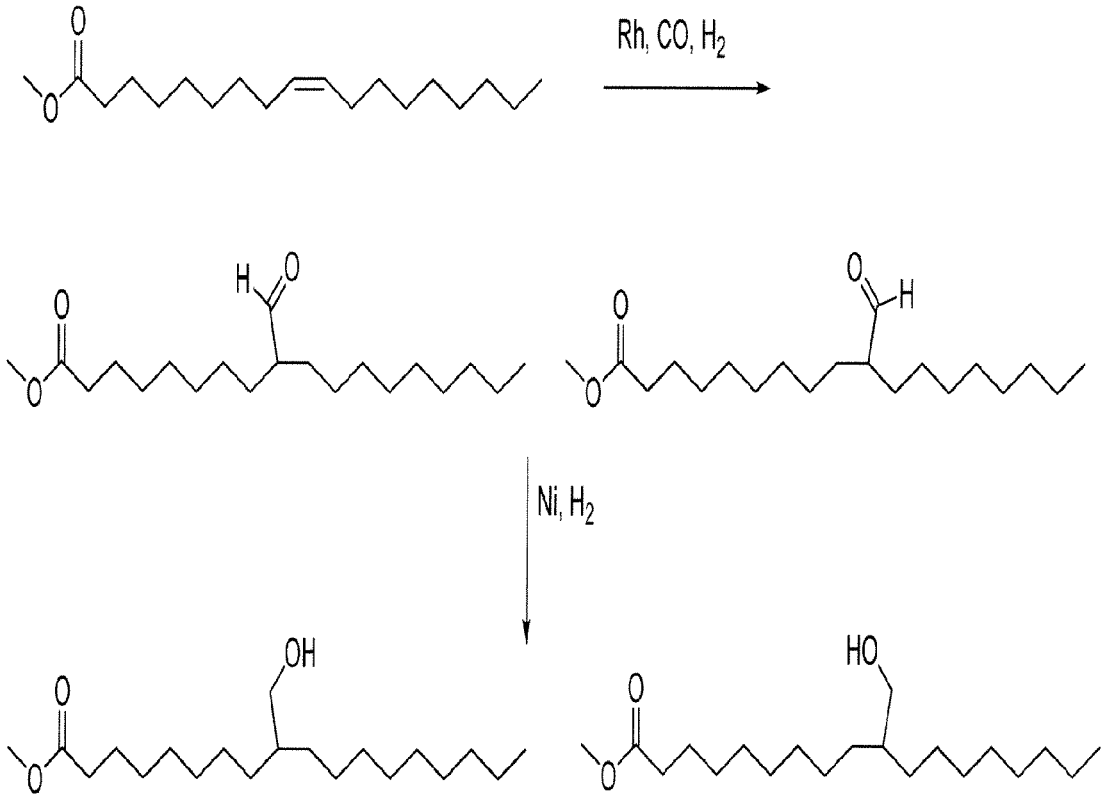

These saturated and unsaturated materials may be converted to hydroxyl-bearing fatty acids via a hydroformylation (alternatively known as the oxo process or oxo synthesis) and hydrogenation sequence. For example, oleic acid, an unsaturated fatty acid, may be converted to form the HMS used as a starting material in the present invention, via a pre-inventive hydroformylation and hydrogenation sequence as shown in FIG. 2.

It will be noted, however, that because there is essentially no selectivity in the hydroformylation reaction, the result is that the C-9 and C-10 carbons are equally hydroformylated, and thus a mixture of two alcohols results from subsequent hydrogenation. This means that ultimately four compounds are produced when methyl linoleate is hydroformylated and hydrogenated, while six compounds result when methyl linolenate is hydroformylated and hydrogenated, respectively. This mixture of HMS compounds may be used as is as a starting material for the inventive process, or the monofunctional oleic and difunctional linoleic fatty esters that the mixture comprises can be readily separated and used individually as the starting HMS.

Once the HMS has been procured or prepared, it is ready for use in the first step of the inventive process. This step involves a transesterification of the HMS wherein it is reacted with a linear or branched C3 to C20 alcohols under suitable conditions to form the hydroxy methyl ester. In preferred embodiments this alcohol or branched alcohol may be a C6 to C12 alcohols, and more preferably a C8 to C10 alcohols. Preferred conditions for this reaction include a stoichiometric excess of the alcohol, more preferably from three (3) to six (6) times the amount that would be stoichiometric with the HMS, and most preferably four (4) to six (6) times. It is also desirable to use an effective transesterification catalyst selected from, for example, sodium or potassium bases, such as sodium methoxide ($NaOCH_3$) alkyl tin oxides, such as tri-n-butyltin oxide or dibutyltin dilaurate; titanate esters; and acids such as hydrochloric or sulfuric; a temperature ranging from 100° C. to 200° C., more preferably from 120° C. to 190° C., and most preferably from 140° C. to 180° C.; atmospheric pressure; and a wiped film evaporator (WFE) to separate and purify the product. Additional understanding of potential process variables, for illustrative purposes only, may be obtained from the examples included in this specification.

Once the hydroxy methyl ester has been prepared—for example, where a reaction of HMS and 2-ethyl hexanol has yielded a transesterification product that is 2-ethyl hexyl-9/10-hydroxymethyl stearate, or a reaction of HMS and 2-ethyl hexanol has yielded a transesterification product that is 2-ethyl hexyl-9/10-hydroxy methyl stearate is then esterified, in a second process step, by reacting it with an esterification, or capping, agent, which is a linear or branched C4-C20, preferably a C6-C12, and more preferably a C8-C10, carboxylic acid. This acid is selected from free acid chlorides, fatty acid chlorides, carboxylic acid anhydrides, and combinations thereof. The purpose of this second step is to functionalize, i.e., to end-cap the free hydroxyl groups, thereby increasing branching while imparting a higher fire point.

When this second step is carried out under suitable conditions, the result is a capped oxyalkanoic ester based on HMS. For example, if the hydroxy methyl ester is 2-ethylhexyl stearate and the second step esterification (i.e., capping) is done using an acid chloride such as decanoyl chloride acid, the result is 2-ethylhexyl-9/10-methyl-oxydecanoyl stearate. If the hydroxy methyl ester is 2-ethyloctyl stearate, and the second step esterification is done using octanoyl chloride acid, the result is 2-ethyloctyl-9/10-oxyoctanoyl stearate. If the hydroxy methyl ester is 2-ethyloctyl stearate, and the second step esterification is done using isobutyric anhydride, the result is 2-ethyloctyl-9/10-oxyisobutyrate stearate. Those skilled in the art will understand that there are many other embodiments of the invention, depending upon the dimer (i.e., the hydroxy methyl ester) and capping agent selected, and that the examples herein are provided for illustrative purposes only and are not intended to represent the full scope of the invention in any sense.

Preferred conditions for this second step reaction include a slight stoichiometric excess of the capping agent (preferably from 1 molar percent (mol %) to 10 mol %, more preferably from 0.5 mol % to 5 mol %, and most preferably from 0.1 mol % to 0.2 mol %). It is also desirable to use an effective esterification catalyst selected from, for example, sodium or potassium bases, such as sodium methoxide ($NaOCH_3$); alkyltin oxides, such as tri-n-butyltin oxide or dibutyltin dilaurate; titanate esters; and acids such as hydrochloric or sulfuric; temperatures ranging from 100° C. to 200° C., more preferably from 120° C. to 190° C., and most preferably from 140° C. to 180° C.; atmospheric pressure; and use of any suitable distillation means such as evaporation WFE. It is noted that at commercial scale, a free carboxylic acid, such as decanoic acid, may be more economical than a fatty acid chloride or an anhydride. Additional understanding of potential process variables, for illustrative purposes only, may be obtained from the examples included in this specification.

Figure 3:
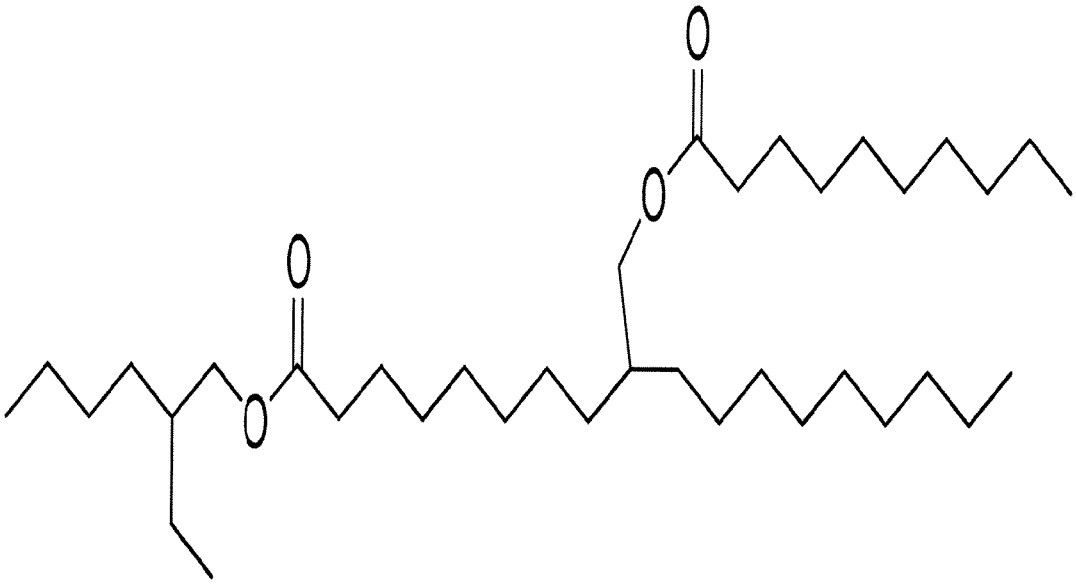
Figure 4:
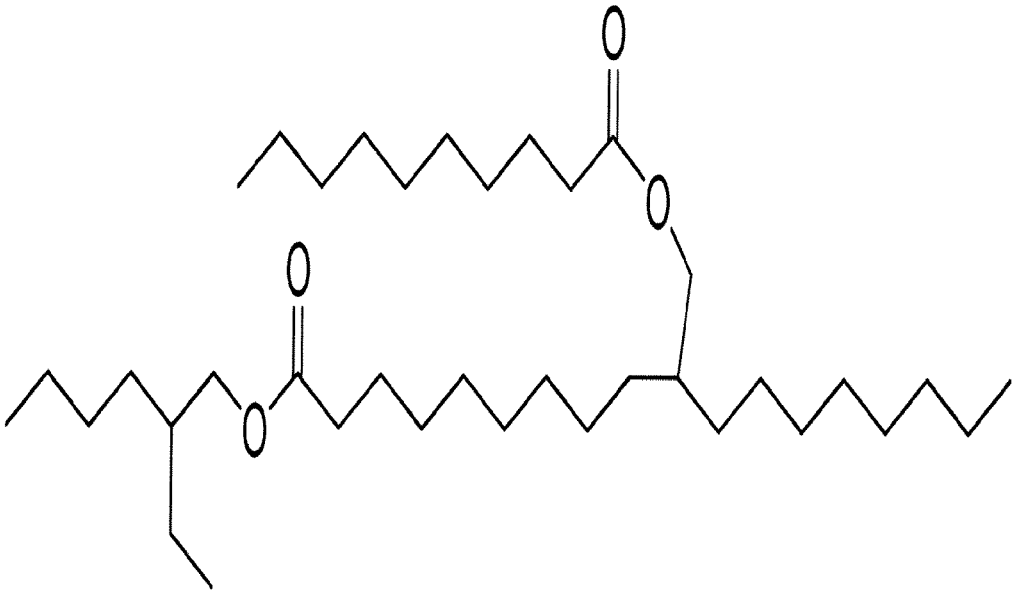

The following FIG. 3 and FIG. 4 are provided in order to illustrate the two possible products of the invention where the process is begun with the hydroformylation and hydrogenation of an unsaturated acid such as oleic acid. For illustrative purposes only, FIG. 3 shows 2-ethylhexyl-10-methyl-oxydecanoyl stearate. FIG. 4 shows 2-ethylhexyl-9-methyl-oxydecanoyl stearate. Both compounds will typically be included when the process of the invention is carried out as described and using the described materials. The presence of combinations of such closely-related derivative products may in many cases contribute to significant increases in fire point temperature and reductions in pour point temperatures. For example, combining the compounds shown in FIG. 3 and FIG. 4, which may be pre-combined as a result of hydroformylation of methyl linolenate, which results in two alcohols, enables simplified production of a desirable combination dielectric fluid composition.

The combinations of these materials, in the dielectric fluid composition made according to the invention as the product of the two-step reaction sequence, may exhibit as properties a fire point of 305° C. with a pour point below −30° C.

When prepared as described herein, the novel compositions which may be prepared by the process described hereinabove may exhibit highly desirable properties. For example, they may have an $M_n$ from 400 Da to 10,000 Da, preferably 500 Da to 5,000 Da; a dielectric breakdown greater than 20 kilovolts/1 mm gap, preferably greater than 25 kV/mm gap; a dissipation factor less than 0.2% at 25° C., preferably less than 0.1% at 25° C.; a fire point (alternatively termed "flash point") greater than 250° C., preferably greater than 300° C.; a kinematic viscosity less than 35 cSt at 40 ° C, preferably less than 30 cSt at 40° C; a pour point lower than −30° C., preferably lower than −40° C.; and/or an acidity less than 0.03 mg KOH/g, preferably less than 0.025 mg KOH/g.

A further advantage to the dielectric fluid compositions of the present invention is that they may be used neat, i.e., at 100 weight percent (wt %) of a dielectric fluid being used in an application such as in a transformer, or they may be combined with, and compatible with, a variety of other dielectric fluids for such applications, at levels ranging from 1 wt % to 100 wt %. In particular embodiments it may be preferred that the inventive compositions comprise from 30 wt % to 90 wt % of such combination fluids, and in more preferred embodiments such may comprise from 40 wt % to 90 wt %, and most preferably from 50 wt % to 90 wt %.

Additional dielectric fluids that may be combined with the dielectric fluid compositions of the present invention may include, in non-limiting example, natural triglycerides such as sunflower oil, canola oil, soy oil, palm oil, rapeseed oil, cottonseed oil, corn oil, coconut oil, and algal oils; genetically modified natural oils such as high oleic sunflower oil and high oleic canola oil; synthetic esters such as pentaerythritol esters; mineral oils such as UniVolt™ electrical insulating oils (available from ExxonMobil); poly alpha olefins such as polyethylene-octene, -hexane, -butylene, -propylene and/or -decalene branched, random co-polyoligomers having $M_n$ values ranging from 500 Da to 1200 Da; and combinations thereof. It will be obvious to those skilled in the art that inclusion of additional dielectric and/or non-dielectric fluids may significantly alter properties, and that therefore the effect of such should be taken into account according to the targeted application.

Among the advantages of the dielectric fluid compositions of the invention is that they are biodegradable, obtained from renewable resources, and are generally classified as environmentally friendly. Furthermore, because of their relatively high fire points, they are generally less flammable than many of their dielectric competitors. They also show good thermal and hydrolytic stability properties that may serve to extend the insulation system's life.

EXAMPLES

Example 1

HMS/ME-810 (A Roughly 50:50 Weight % Blend of Octanoic and Decanoic Acids)

Day 1: 800.06 grams (g) of HMS is weighed out into a 3000 milliliter (mL), three neck round bottom flask. A condenser, Dean Stark Trap, thermometer with a thermowatch temperature regulator, an overhead mechanical stirrer, stopper, and $N_2$ inlet are added. The reaction is stirred and 843.51 g of ME-810 is added and the reaction is heated to 160° C. The progress of the reaction is monitored by gel permeation chromatography (GPC) and after 32 mL of overhead is collected in the Dean Stark trap, the reaction is cooled and the crude mixture is purified by means of a WFE using continuous flow and using the following conditions:

TABLE 2

Conditions for separation of hydroxy methyl ester.

| Jacket (° C.) | Cold Finger (° C.) | Stir Speed (rpm) | Pressure (mtorr) | Flow Rate (mL/min) |
|---|---|---|---|---|
| 130 | 20 | 520 | 160 | 5.5 |

The bottoms are collected and the overhead is discarded. The bottoms are put through the WFE again to complete the removal of unreacted ME-810 acids and unreacted HMS. The solution is a clear, golden yellow color.

TABLE 3

Conditions for further purification of hydroxy methyl ester.

| Jacket (° C.) | Cold Finger (° C.) | Stir Speed (rpm) | Pressure (mtorr) | Flow Rate (mL/min) |
|---|---|---|---|---|
| 110 | −5.2 | 548 | 200 | 5.0 |

Example 2

HMS/2-ethyl-1-hexanol/Decanoyl Chloride

Day 1: 245.8 g of 2-ethyl-1-hexanol is weighed into a 1000 mL, three neck round-bottom flask. A condenser, Dean Stark Trap, thermometer with a thermowatch temperature regulator, an overhead mechanical stirrer, and $N_2$ inlet are added. The stirrer is turned on. ½ cube of sodium (Na) metal (~0.179 g, flattened, cut into small pieces) is added to the flask. The heat is turned up to 60° C. The sodium dissolved after 45 minutes. 204.92 g of HMS is added to the flask. Insulation is wrapped around the flask and the reaction is heated to 160° C. At 120° C., methanol starts collecting in the Dean Stark trap. After 6 hours (h), gas chromatography (GC) confirms the reaction is complete. When the reaction is cooled, 50 mL of toluene, 50 mL of deionized (DI) water ($H_2O$) is added and neutralized with 30 mL 1N HCl. The reaction is washed with water to remove the sodium chloride and the organic layer is dried over anhydrous $MgSO_4$. Toluene and unreacted 2-ethyl-1-hexanol are removed in vacuo. GC confirms there is still an excess of 2-ethyl-1-hexanol, so the sample is put through the WFE using the following conditions. The overhead cut containing 2-ethyl-1-hexanol is discarded.

TABLE 4

Conditions for removal of excess 2-ethyl-1-hexanol.

| Jacket (° C.) | Cold Finger (° C.) | Stir Speed (rpm) | Pressure (mtorr) | Flow Rate (mL/min) |
|---|---|---|---|---|
| 150 | 0 | 497 | 10 | 1.5 |

209.75 g of product is weighed into a 1000 mL, three-neck, round-bottom flask. A condenser, thermometer with a thermowatch temperature regulator, an overhead mechanical stirrer, stopper, and $N_2$ inlet are added. The stirrer is turned on. 50 mL of toluene is added. Using an addition funnel, 104.54 g, a 1.2 molar excess, of decanoyl chloride is added. After 1 h, the decanoyl chloride is added and the reaction is allowed to continue stirring with no heat overnight. The next day, the GC confirms that the reaction is complete.

100 mL of methanol is added to the sample to convert unreacted acid chloride. The reaction is washed with water to remove excess HCl. The aqueous layer is discarded. The organic layer is dried using $MgSO_4$, anhydrous powder, and the toluene and methanol are removed in vacuo. The sample is run down the WFE using the same conditions as earlier to remove any excess solvent. The overheads are discarded. Acid number is determined to be 0.054 mg KOH/g.

Example 3

HMS/2-ethylhexanoic acid

Day 1101.05 g of HMS is weighed into a 500 mL, three neck round bottom flask. A condenser, Dean Stark Trap, thermometer with a thermowatch temperature regulator, an overhead mechanical stirrer, stopper, and $N_2$ inlet are added. The stirrer is turned on. Insulation is wrapped around the flask. 132.9 g of 2-ethyl hexanoic acid is added. The heat is turned up to 170° C. The progress of the reaction is monitored by GPC to determine molecular weight of the product. Upon completion, the unreacted 2-ethyl hexanoic acid is removed by WFE using the following conditions. The product is a clear, golden yellow color. The overhead is discarded.

TABLE 5

Conditions for removal of unreacted 2-ethyl hexanoic acid.

| Jacket (° C.) | Cold Finger (° C.) | Stir Speed (rpm) | Pressure (mtorr) | Flow Rate (mL/min) |
|---|---|---|---|---|
| 160 | 25 | 424 | 210 | 4.3 |

Example 4

HMS/2-ethyl-1-hexanol/Octanoyl Chloride

Day 1: 353.67 g of 2-ethyl-1-hexanol is weighed into a 2000 mL three-neck, round-bottom flask. A condenser, Dean Stark Trap, thermometer with a thermowatch temperature regulator, an overhead mechanical stirrer, stopper, and $N_2$ inlet are added. The stirrer is turned on. Na metal (~0.52 g, flattened, cut into small pieces) is added to the flask and the reaction is heated to 60° C. The sodium dissolves after 45 minutes. 300 g of HMS sunflower monomer is added to the flask. Insulation is wrapped around the flask. The heat is turned up to 160° C. At 120° C. methanol overhead starts collecting. After 4 h, GC confirms the reaction is complete. The heat is turned off. 16.5 mL of overhead is collected. When the reaction is cooled, 100 mL of toluene and 100 mL of DI $H_2O$ are added and neutralized with 30 mL 1N HCl. 3 water washes are done and separated using a separatory funnel. The aqueous layer is discarded. $MgSO_4$, anhydrous powder, is added to the Erlenmeyer flask until the $MgSO_4$ stops clumping in the flask. The solution is then clear. To remove the toluene and excess 2-ethyl-1-hexanol, the sample is evaporated using a rotary evaporator (rotavap) secured with a pump. First the water bath temperature is set at 40° C. to remove the toluene, and then it is bumped up to 90° C. to remove the 2-ethyl-1-hexanol. GC confirms there is still an excess of 2-ethyl-1-hexanol, so the sample is put through the WFE using the following conditions.

TABLE 6

Conditions for removal of excess 2-ethyl-1-hexanol.

| Jacket (° C.) | Cold Finger (° C.) | Stir Speed (rpm) | Pressure (mtorr) | Flow Rate (mL/min) |
|---|---|---|---|---|
| 140 | 0 | 611 | 80 | 2.0 |

291 g of product is weighed into a 2000 mL three neck round bottom flask. A condenser, thermometer with a thermowatch temperature regulator, an overhead mechanical stirrer, stopper, and $N_2$ inlet are added. The stirrer is turned on. 150 mL of toluene is added. Using an addition funnel, 119.2 g, a 1.2 molar excess, of octanoyl chloride is added. After 1 h, the addition of the octanoyl chloride is completed and the reaction is allowed to continue stirring with no heat overnight. The next day, GC confirms that the reaction is complete.

200 mL of methanol is added to the sample. The sample is put on the rotavap to remove the toluene and methanol. The sample is run down the WFE using the same conditions as earlier to remove any excess solvent. The overheads are discarded. The sample is put into a freezer overnight and in the morning, it is found to have not frozen. Acid number is determined to be 0.046 mg KOH/1 g.

What is claimed is:

1. A dielectric fluid composition for electrical apparatus comprising a functionalized methyl-9-carboxy methyl stearate, methyl-10-carboxy methyl stearate, or methyl-12-carboxy methyl stearate having at least one property selected from:

(a) a number average molecular weight from 400 Daltons to 10,000 Daltons;
(b) a dielectric breakdown greater than 20 kilovolts/1 mm gap;
(c) a dissipation factor less than 0.2 percent at 25° C.;
(d) a fire point greater than 250° C.;
(e) a kinematic viscosity less than 35 centistokes at 40° C.;
(f) a pour point lower than −30° C.;
(g) an acidity less than 0.03 mg KOH/g; and
(h) a combination thereof.

2. The dielectric fluid composition of claim 1, wherein the functionalized methyl-9-carboxy methyl stearate, methyl-10-carboxy methyl stearate, or methyl-12-carboxy methyl stearate is present in an amount ranging from 1 weight percent to 100 weight percent.

3. The dielectric fluid composition of claim 2, wherein the functionalized methyl-9-carboxy methyl stearate, methyl-10-carboxy methyl stearate, or methyl-12-carboxy methyl stearate is present in an amount ranging from 30 weight percent to 90 weight percent.

4. The dielectric fluid composition of claim 1, further comprising a natural triglyceride; a genetically modified natural oil; another synthetic ester; a mineral oil; a poly alpha olefin; an algal oil; or a combination thereof.

5. The dielectric fluid composition of claim 1, wherein the number average molecular weight is from 400 Daltons to 5,000 Daltons.

* * * * *